United States Patent [19]

Quazi et al.

[11] Patent Number: 4,933,605

[45] Date of Patent: Jun. 12, 1990

[54] FLUORESCENT DIMMING BALLAST UTILIZING A RESONANT SINE WAVE POWER CONVERTER

[75] Inventors: Fazle S. Quazi; Kenneth W. Peek, both of Boulder, Colo.

[73] Assignee: Etta Industries, Inc., Boulder, Colo.

[21] Appl. No.: 147,574

[22] Filed: Jan. 19, 1988

Related U.S. Application Data

[63] Continuation-in-part of Ser. No. 61,109, Jun. 12, 1987, abandoned.

[51] Int. Cl.[5] ..... H05B 37/02

[52] U.S. Cl. ..... 315/224; 315/244; 315/243; 315/DIG. 2; 315/DIG. 4; 315/DIG. 5

[58] Field of Search ..... 315/224, 244, 243, DIG. 2, 315/DIG. 4, DIG. 5, DIG. 7, 101, 307, 98, 311, 210, 209 R; 363/15

[56] References Cited

U.S. PATENT DOCUMENTS

| | | | |
|---|---|---|---|
| 4,127,795 | 11/1978 | Knoll | 315/224 |
| 4,350,891 | 9/1982 | Wuerflein | 363/15 |
| 4,353,009 | 10/1982 | Knoll | 315/278 |
| 4,370,600 | 1/1983 | Zansky | 315/243 |
| 4,392,087 | 7/1983 | Zansky | 315/244 |
| 4,544,863 | 10/1985 | Hashimoto | 315/224 |
| 4,641,061 | 2/1987 | Munson | 315/244 |
| 4,700,113 | 10/1987 | Stupp et al. | 315/224 |

FOREIGN PATENT DOCUMENTS

| | | | |
|---|---|---|---|
| 0655042 | 3/1979 | U.S.S.R. | 363/15 |

OTHER PUBLICATIONS

"Siemens Consumer IC Data Book 1987/88", pp. 643–645 (copy submitted herewith).

"Siemens Energy and Automation", vol. 11, No. 2, March/April, 1985 (copy not available to Applicants).

*Primary Examiner*—Leo H. Boudreau
*Assistant Examiner*—Michael Razavi
*Attorney, Agent, or Firm*—Sixbey, Friedman, Leedom & Ferguson

[57] ABSTRACT

In a method or combination, a DC voltage supply, a converter including a series or a parallel resonant circuit for converting the DC voltage to a sinusoidal current, and a load including at least one fluorescent lamp responsive to the sinusoidal current to effect excitation of the lamp.

29 Claims, 16 Drawing Sheets

$C_D$ = DARK SPACE CAPACITANCE $R_D$ = RESISTIVE PART ASSOCIATED WITH $C_D$ $C_P$ = PLASMA CAPACITANCE $R_P$ = RESISTIVE PART ASSOCIATED WITH $C_P$ AND $L_P$ $L_P$ = PLASMA INDUCTANCE

FLUORESCENT DIMMING BALLAST UTILIZING A RESONANT SINE WAVE POWER CONVERTER

This application is a continuation-in-part of application Ser. No. 061,109, filed Jun. 12, 1987, now abandoned.

It is recognized in the prior art that conventional core and coil ballasts for fluorescent lamps waste significant energy and generate unnecessary heat.

Additionally since core and coil ballasts operate on 50/60 Hz, alternating current line frequency variation, flickering of the fluorescent lamp and hum are a common problem. A detailed scientific evaluation of the performances of core and coil ballasts and solid-state ballasts has been reported by R. R. Verderber and O. Morse. See *Performance of Electronic Ballasts and Other New Lighting Equipment*, Lawrence Berkeley Laboratory, University of California, Report Prepared for the U.S. Department of Energy under Contract DE-AC03-76SF00098, October, 1985.

Accordingly, there has been a scientific endeavor to develop energy saving solid state electronic ballasts and circuitry for fluorescent lamps. A review of electronic ballasts is given in *Energy User News*, Sept. 8, 1986, p. 12; *Energy User News*, Aug. 1, 1983, p. 10; and J. E. Jewell, S. Selkowitz and R. R. Verderber. *Solid-State Ballasts Prove to be Energy Savers*, Lighting Design and Application, Vol. 10, No. 10, January 1980, pp. 36–42.

Existing solid-state dimming ballasts for fluorescent lamps have proven to be superior in efficiency to the core and coil ballasts; however, solid state ballasts also have attendant disadvantages. In addition to being relatively expensive, solid state ballasts have a comparable high failure rate, and produce significant amounts of electromagnetic radiation due to the presence of strong high frequency harmonics. A review of solid state ballasts is given in *EBT' s Electronic Ballasts. . .* , Energy Users News, Vol. 9, Apr. 30, 1984, pp. 1 (3) and NTIS Energy Tech Notes, November, 1983, pp. 7–8.

SUMMARY OF THE INVENTION

The present invention is directed to a modified solid-state resonant converter switching circuit utilized as a dimming ballast for a fluorescent lamp. The improved circuit retains the advantages of the conventional resonant converter circuit and, at the same time, provides ideal excitation of the weakly ionized plasma mode on which fluorescent lamps operate. Thus, the modified convertor switching circuit constitutes an excitation source that is sinusoidal with zero current switching of the power switches. Moreover, constant filament voltage is provided to the fluorescent lamps.

The preferred embodiment of the electronic dimming ballast converter switching circuit in essence combines a modified resonant converter circuit with a radio frequency excited gaseous plasma circuit to obtain the various advantages described herein.

OBJECT OF THE PRESENT INVENTION

It is accordingly a principal object of the present invention to provide a new and improved electronic dimming ballast circuit for one or more fluorescent lamps, without the attendant disadvantages of the prior art, where the ballast utilizes the principles of a resonant power converter, for example, a serial or a parallel resonant converter having zero current switching through power switches and wherein the lamp excitation current is sinusoidal.

It is another object of the present invention to provide a new and improved electronic dimming ballast circuit for a fluorescent lamp that has improved power conversion efficiency.

A further object of the present invention is to utilize a resonant converter switching circuit to provide the excitation to multiple fluorescent lamps arranged in series, parallel or series/parallel; wherein the separate filament voltages to each of the fluorescent lamps is maintained constant; and wherein the circuit is operable at a high switching frequency to thereby eliminate hum and light flickering.

Other objects and features of the present invention will become apparent with a reading of the following specification when taken in conjunction with the drawings in which:

DETAILED DESCRIPTION OF THE PREFERRED EMBODIMENT

Figure 1:
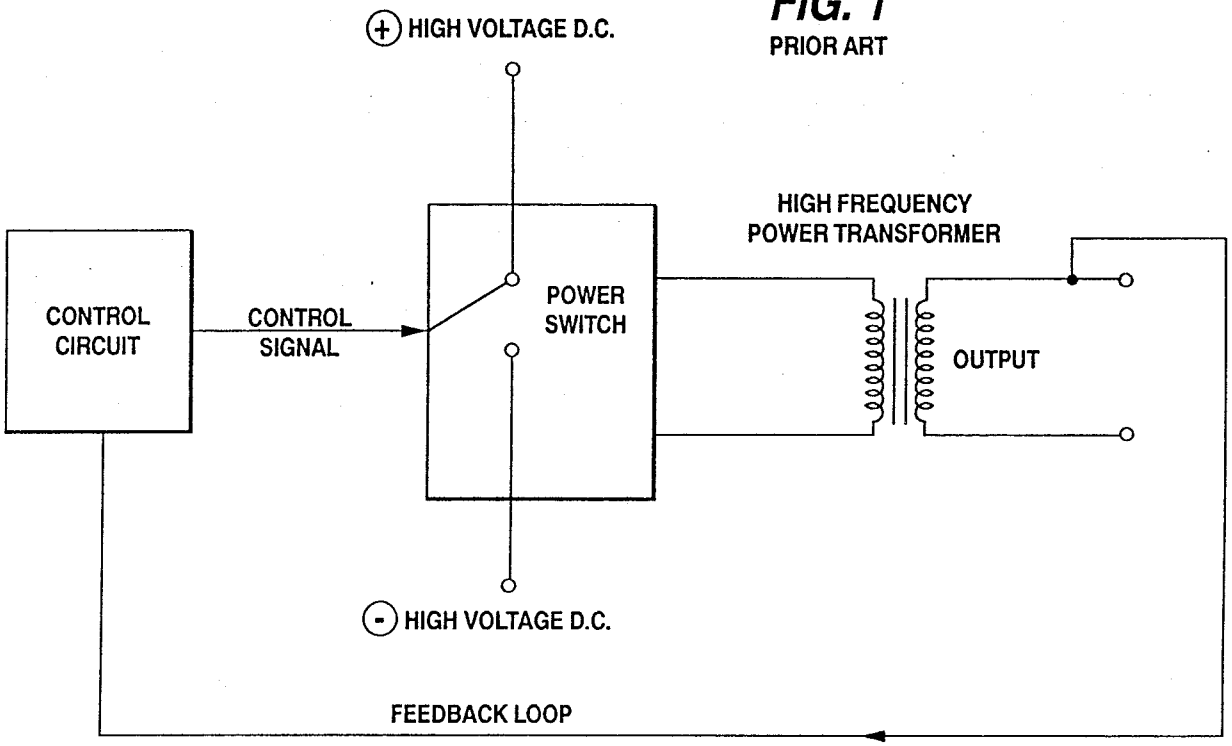
FIG. 1 PRIOR ART
FIG. 1 illustrates a prior art switching mode power converter utilized as a solid-state ballast for a fluorescent lamp.

Reference should be made to the drawing where like reference numerals refer to like parts.

Figure 2:
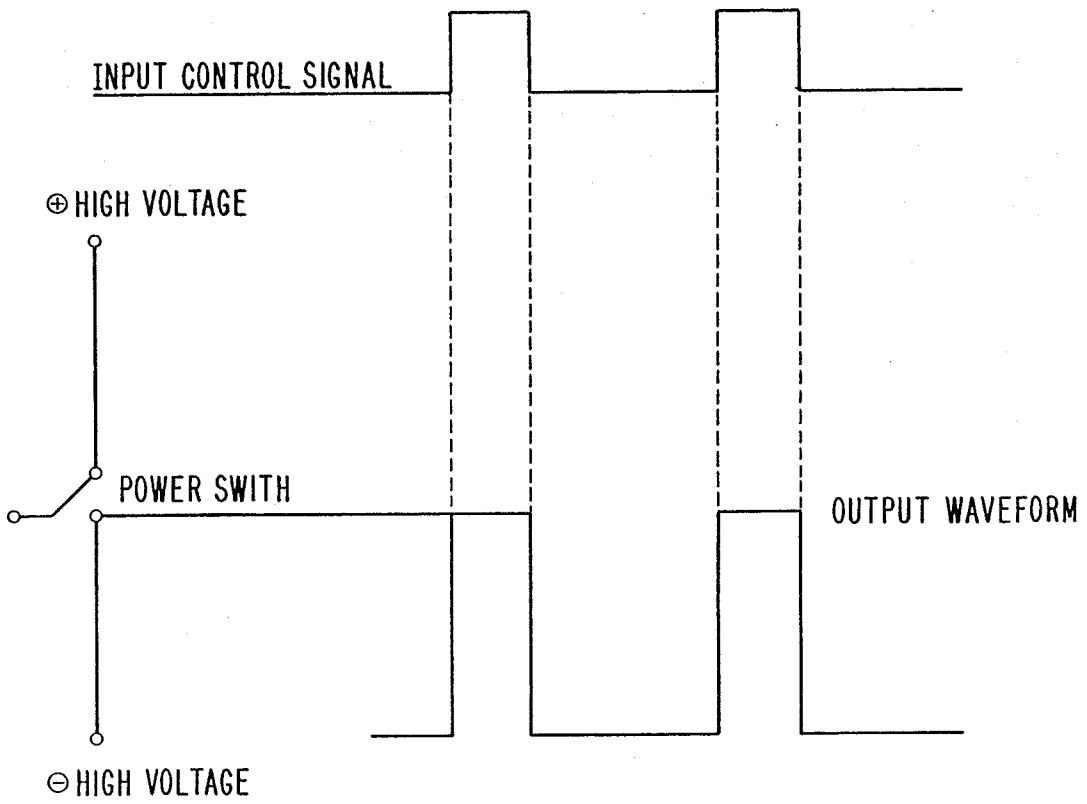
FIG. 2 (PRIOR ART)
FIG. 2 illustrates an illustrative waveform of an input control signal to the circuit of FIG. 1 and the waveform of the output voltage/current therefrom.

In FIG. 1, there is illustrated a generalized schematic block diagram of a conventional switch mode power supply utilized as a solid state ballast for fluorescent lamps. These types of ballast switches are popularly termed as forward converters, full bridge, or push pull types, etc. In these circuits, the control signal as shown in FIG. 2, is a square wave and in turn the output voltage/current is a square wave. Thus, the power switches must switch the current at its maximum. As a consequence, there are higher harmonic contents (higher EMI), stronger current and voltage spikes or transients through the power switches, and excessive heat dissipation resulting in reduction in life of the switches.

Figure 3:
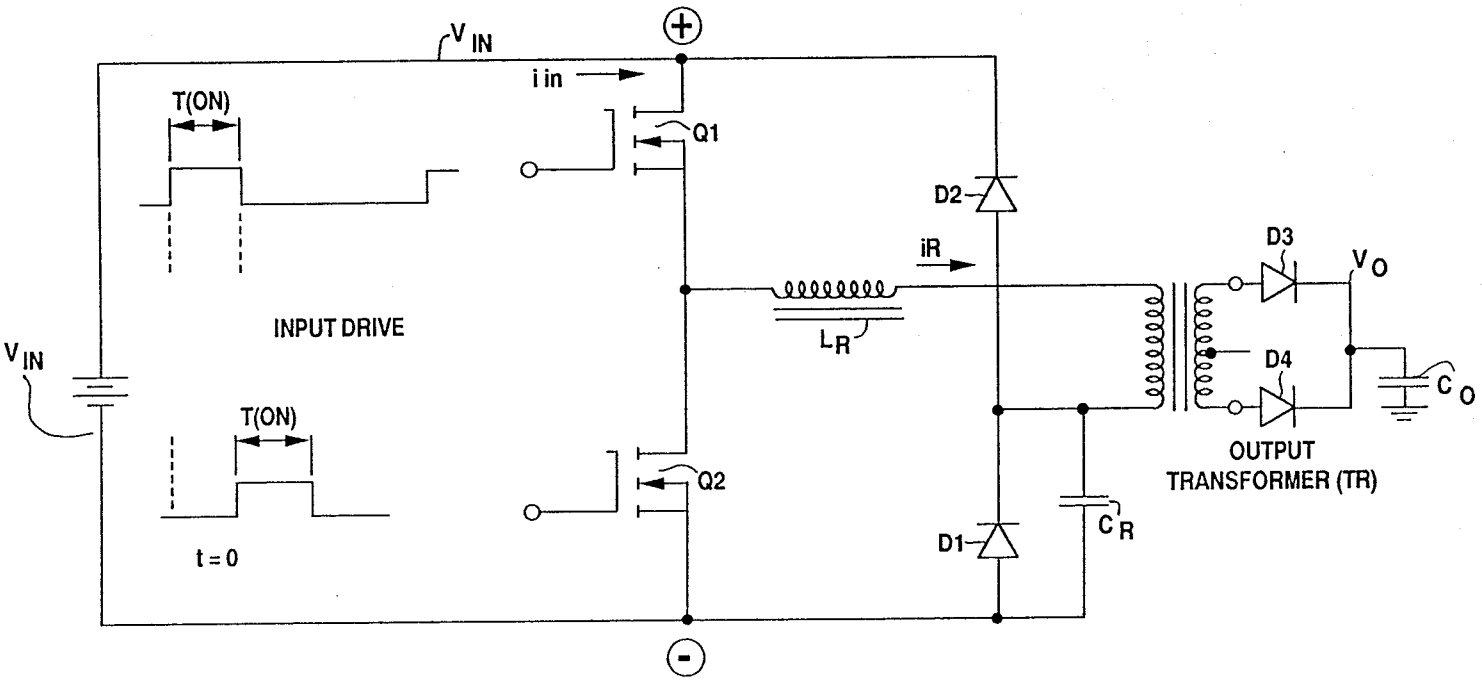
FIG. 3 PRIOR ART
FIG. 3 illustrates a conventional series resonant power converter circuit.
Figure 4:
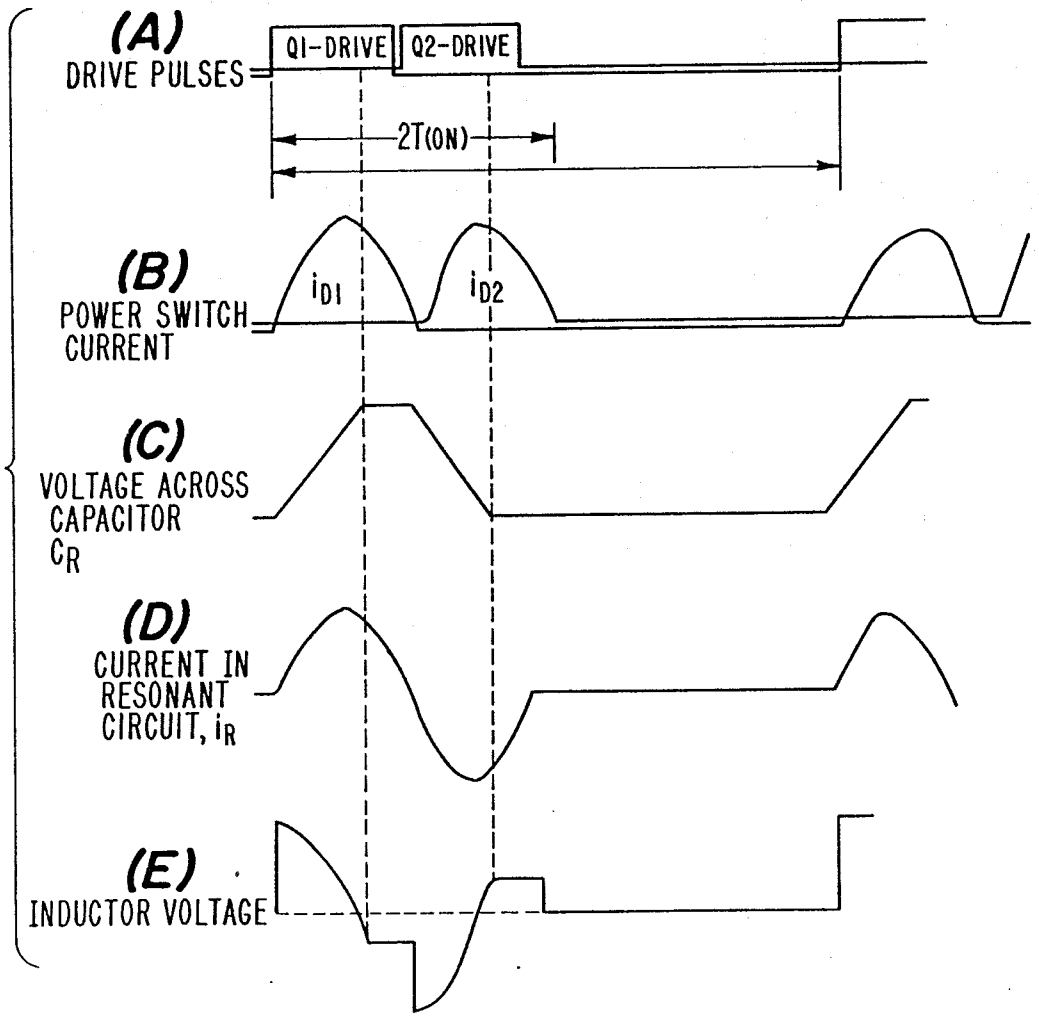
FIG. 4 (PRIOR ART)
FIGS. 4A–4E depict the attendant waveforms in the operation of the circuit of FIG. 3.

During the last several years, designers involved with power conversion technology have considered resonant sine wave power supplies. With reference to FIG. 3 there is illustrated such a supply. Major advantages of this power conversion technology are higher overall efficiency, reduction in EMI, and increased reliability.

The basic principle of operation of the series resonant converter is reviewed with reference to the block schematic diagram of FIG. 3 taken in conjunction with the waveforms of FIGS. 4A–4E. During the on-time of transistor power switch Q1, the energy is delivered from the input supply $V_{IN}$ to the output load and to the series resonant capacitor $C_R$. During the on-time of transistor power switch Q2, the energy is transferred from capacitor $C_R$ to the output load. The rectifier diodes D1 and D2, clamp the voltage across capacitor $C_R$ by providing a current path across the VIN supply or ground. The alternating current in the secondary winding of the output transformer TR is rectified by rectifier diodes D3 and D4 and filtered with output filter capacitor $C_o$.

With reference to the waveforms in FIGS. 4A through 4E, there is depicted voltage and current waveforms at different points of the conventional series resonant converter of FIG. 3.

FIG. 4A illustrates the waveform of the drive pulses, a first series of pulses for Q1 having a predetermined pulse width and a second series pulses for Q2 of the same predetermined pulse width but delayed in time to be alternately applied to the power switches Q1 and Q2. The waveform of FIG. 4B illustrates the power switch current $i_{D1}$ and $i_{D2}$ through the transistor Q1 and Q2. The waveform of FIG. 4C depicts the voltage waveform across capacitor $C_R$. In FIG. 4D the sinusoidal current $i_R$ in the inductor $L_R$/capacitor $C_R$ series resonant circuit is illustrated. And FIG. 4E depicts the waveform of voltage across the inductor $L_R$.

In operation of the circuit of FIG. 3 with reference to the waveforms of FIGS. 4A–4E, under steady state condition, the voltage $V_o$ is reflected back to the primary side as $NV_o$, where N is the transformer turns ratio. The polarity of the reflected voltage depends upon the state of transistors Q1 and Q2. When transistor Q1 turns on, the input voltage $V_{in}$ is applied across the series resonant network comprising inductance $L_R$ and capacitance $C_R$ and the primary of the power transformer TR. Since the voltage across the primary is fixed by its turns ratio and the output voltage, the current $i_R$ in the primary increases a sinusoidal manner (starting at zero) because it is controlled by the series resonant network. The voltage across capacitor $C_R$ increases in a sinusoidal manner starting at zero, while the voltage across the inductor $L_R$ decreases toward zero. When the voltage across the inductor $L_R$ reaches zero, the current in the resonant network ceases to increase.

The polarity of the voltage across series resonant inductor $L_R$ reverses and the current starts to decrease from its peak value. The voltage across the resonant capacitor $C_R$ continues to increase until it is clamped by diode D2. The voltage across the series resonant inductor $L_R$ ceases to increase when the voltage across capacitor $C_R$ is equal to one diode drop above the input voltage $V_{IN}$. The voltage across the inductor $L_R$ is equal to the reflected output voltage $NV_o$ across the primary winding of the transformer TR. The current in the primary winding of the transformer decreases in a linear manner.

For proper operation transistor Q1 must remain on until the current in the resonant network reaches zero. The transistor Q2 is then turned on and the current in the primary winding increases from zero, but this time in the reverse direction. The cycle repeats itself as described.

For maximum power transfer in a given design the selected turns ratio of the transformer TR should be such that the reflected output voltage across the primary is equal to half the value of the minimum input supply voltage.

The output $V_o$ is regulated by controlling the duty cycle, using a single cycle sine wave. The required on-time of the power switches varies somewhat depending upon the input voltage variation. To maintain zero current switching, high efficiency and prevent cross conduction, the on-time should be determined at the maximum input voltage.

The high voltage DC applied to the switches Q1 and Q2 may correspond to the difference between a positive voltage and ground or between a positive voltage and a negative voltage or any other two different voltage levels. Adjustment of the DC level of the control signals applied to switches Q1 and Q2 will accommodate whatever voltage levels correspond to the applied high voltage DC.

The primary advantages of the resonant sine wave converter of FIG. 3 are first its higher overall efficiency. This is attributed to lack of power losses normally attributed to the switching of the power switch or rectifier reverse recovery, thereby making the conversion efficiency higher. The absence of switching losses in turn permits a smaller heat sink. Second, a reduction in EMI occurs because the transistor voltage is switched when the current in the switch is zero. Thus, a smaller amount of high frequency energy is radiated from the circuit. Third, increased reliability is attributed to (a) the resonant inductor $L_R$ that provides inherent short circuit protection; (b) the inductor minimizes large current spikes in the power switch during start-up; (c) zero current switching eliminates high peak power stress on the power semiconductor and localized peak junction temperature; (d) voltage and current overshoot are minimized; and (e) the resonant converters are stable under no load operation.

It has been the present applicant's experience from plasma physics that gaseous plasma excitation by high frequency alternating current seems more efficient when the excitation current is sinusoidal. It is presumed that sine wave excitation assists the circuit to reach steady state quickly and that, since a plasma load is primarily capacitive, a plasma load will be more responsive to a sine wave.

Figure 5:
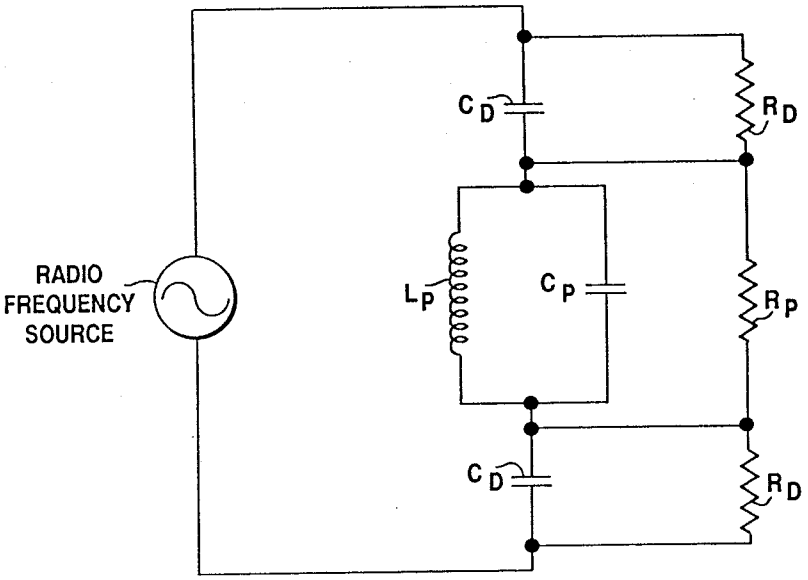
FIG. 5 is a schematic diagram of an equivalent circuit of a radio frequency sine wave excited gaseous plasma.

An equivalent electrical circuit for a radio frequency excited plasma is illustrated in FIG. 5. Since fluorescent lamps operate on a weekly ionized plasma mode, the excitation source for a fluorescent lamp is ideally sinusoidal.

Figure 6:
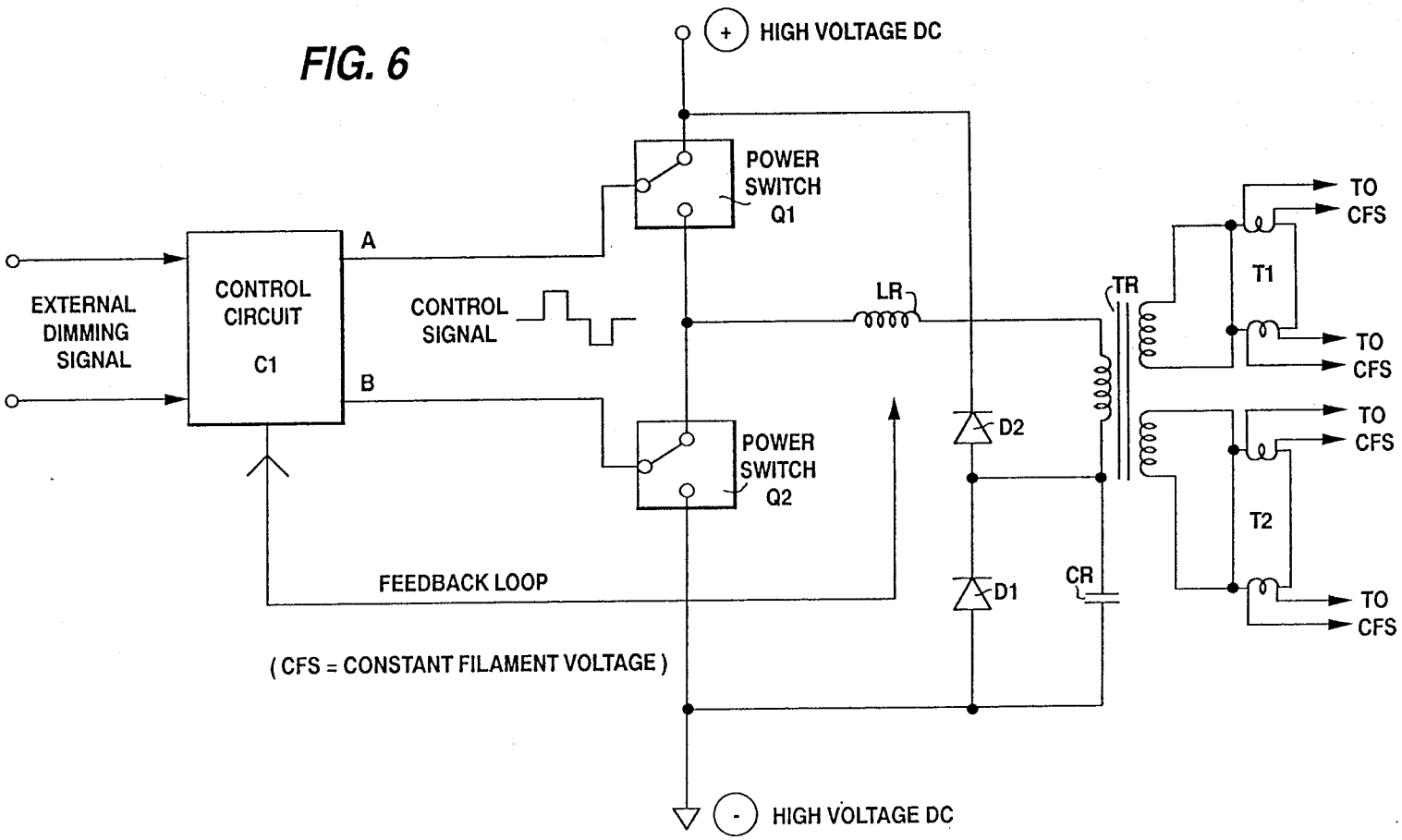
FIG. 6 illustrates an illustrative series resonant converter switching circuit of the present invention that utilizes the electrical principles of the gaseous plasma mode of FIG. 5.

With reference to FIG. 6 there is illustrated one preferred embodiment of the present invention. This embodiment provides a very straightforward, reliable and economical yet efficient technique for excitation of a fluorescent lamp.

In operation, control signals are applied to power switches Q1 and Q2 from the outputs A and B of control circuit C1. A typical control voltage waveform is shown at the output of control circuit C1. The control signal from control circuit C1 drives the power switches Q1 and Q2 in the same manner as set forth above with respect to FIG. 4.

The series resonant converter which was described above with reference to FIG. 3, incorporates a transformer TR as the load between the inductor $L_R$ and the capacitor CR. In the embodiment of FIG. 6, the secondary of the transformer TR has connected thereto a multiple fluorescent lamps T1 and T2. The output sinusoidal voltages across the secondary windings of the transformer TR easily drive the fluorescent lamps.

It is known that for higher efficiency and longer lamp life, fluorescent ballasts should provide constant filament voltage to the filaments of the lamp. This is especially true, as herein when the lamps are operating under dimming conditions. CFS in FIG. 6 indicates constant filament voltage.

Figure 7:
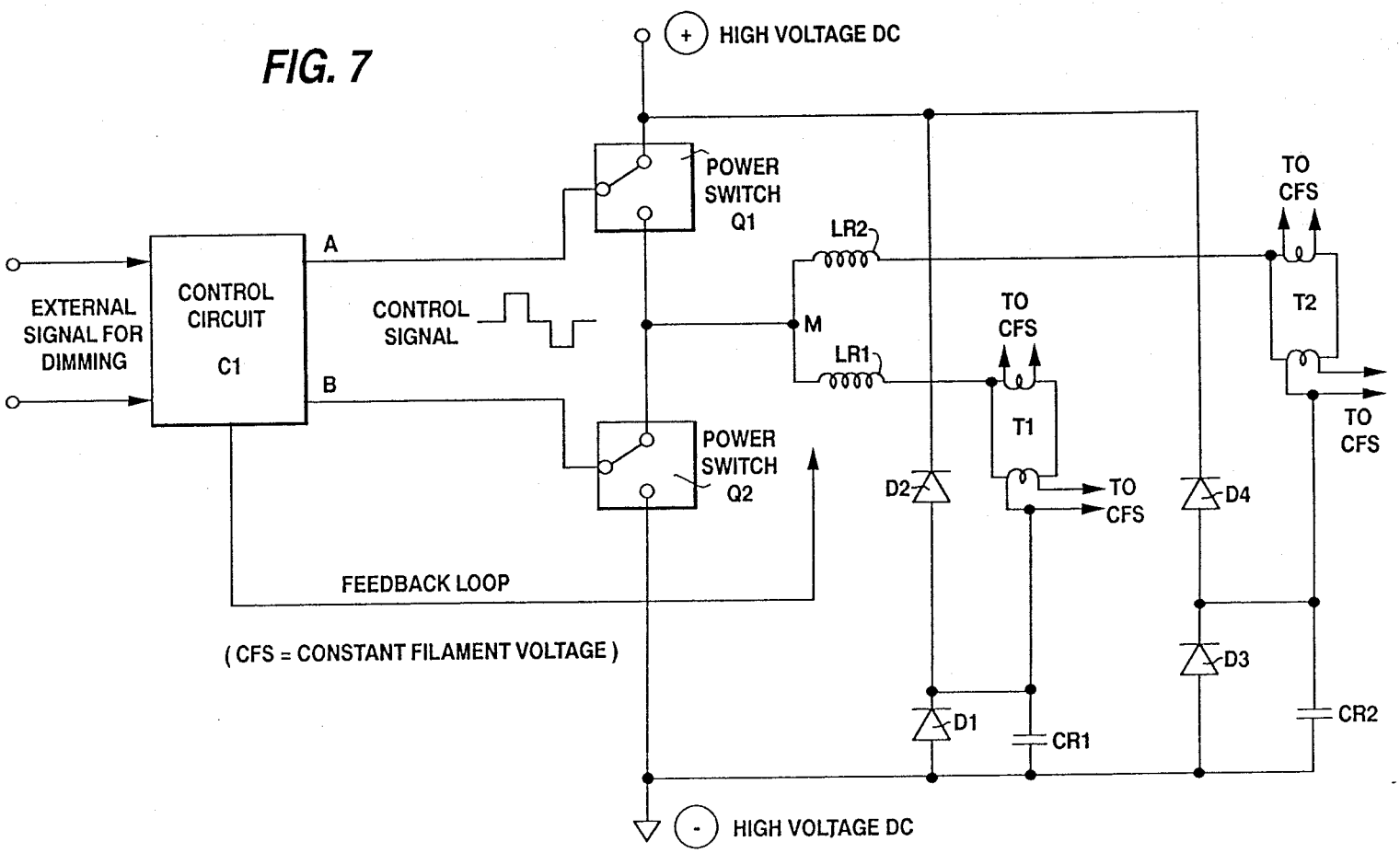
FIG. 7 is an illustrative circuit wherein a fluorescent lamp is an integral component of the modified series resonant convertor circuit of the invention.

A further improvement of the series resonant converter type ballast for fluorescent lamps is illustrated in the circuit of FIG. 7. Thus, the transformer load TR of FIG. 6 is preferably replaced with one or more fluorescent lamp loads whereby the loss due to the transformer is eliminated.

The schematic diagram of FIG. 7 shows parallel operation of multiple lamps T1 and T2. Multiple fluorescent lamps in parallel minimize maintenance time and cost. At the present time, the common practice is to use series parallel arrangements. However, when one lamp is extinguished the other member of the pair is also extinguished. It is necessary therefore to replace the deficient lamp to resume normal operation. Trial and error is necessary to find the deficient lamp. On the other hand, when as shown in FIG. 7, all the lamps are connected in parallel, the extinguished lamp is readily located. Furthermore, the extinguished lamp does not affect the normal operation of the other fluorescent lamps.

Figure 8:
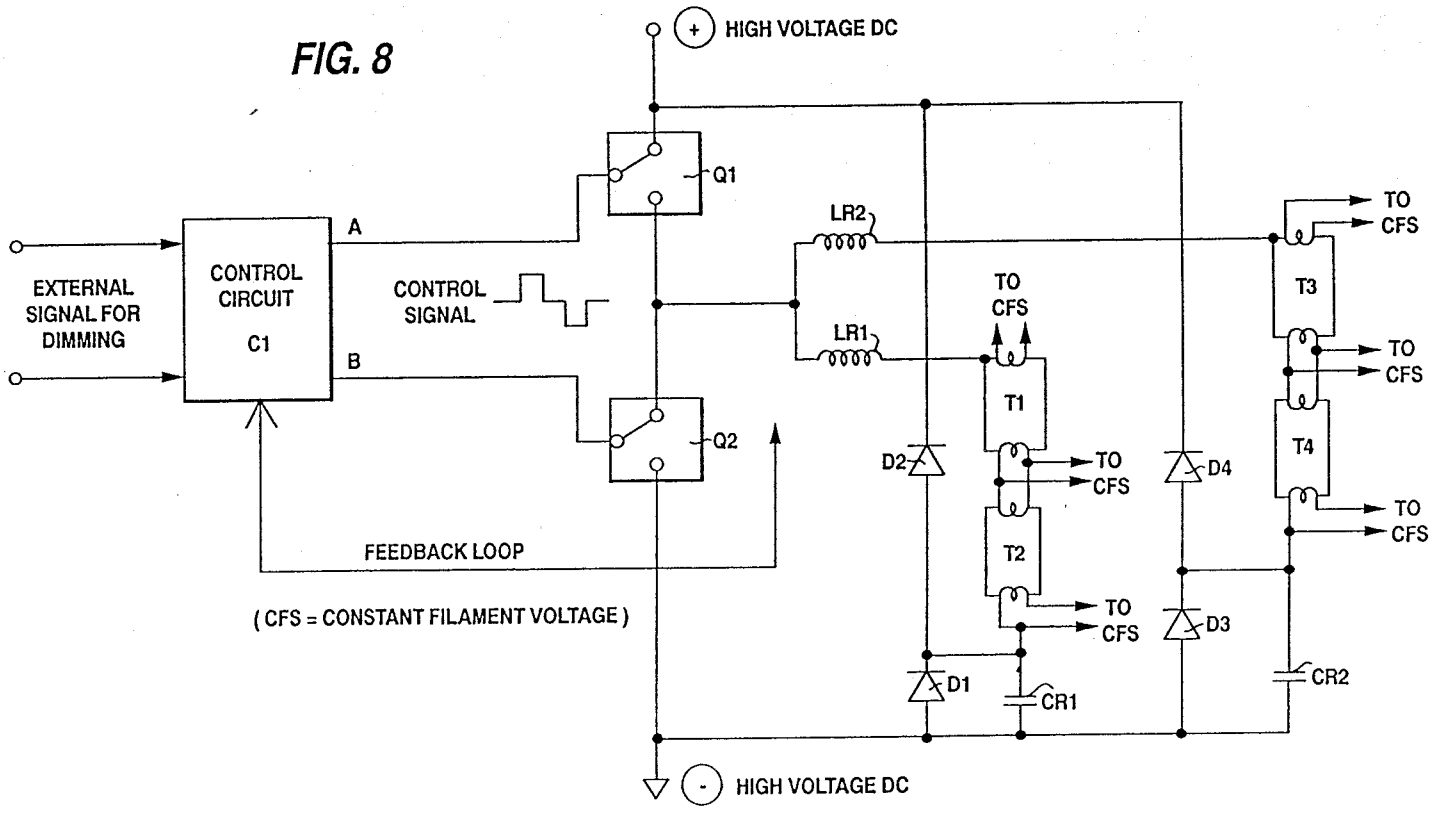
FIG. 8 is an illustrative modification of the circuitry of FIG. 7.

The present invention can also provide many more output configurations, not limited only to the configurations as shown in FIG. 7 and in FIG. 8 where the latter embodiment is directed to a series/parallel arrangement of the lamps. The foregoing is true because the resonant inductor LR (FIG. 6), resonant capacitor CR and the load TR combination can be arranged in any order, as long as they maintain the resonance property.

Another advantage of this invention is that whether the lamps are in parallel (FIG. 7) or are in series/parallel combination (FIG. 8), a separate series inductor and a capacitor (LR1-CR- or LR2-CR2, etc.) limits the current into the circuit, even if the lamps are shorted accidentally.

A feedback loop, as described in further detail below, is preferred for stable operation, under most circumstances. This loop also senses, for example, line voltage variation and thereby helps to maintain constant light output.

Control circuit C1 may be an integrated circuit. One example of an inexpensive but superior integrated control circuit which requires minimum external parts is UC 2525, "Silicon General Product Catalog", Silicon General, Garden Grove, California, 1986, p. 88–93, a simplified schematic of which is illustrated in FIG. 9 and discussed below.

Referring to FIGS. 6, 7, and 8, the feedback loop is shown not connected to any particular point. Rather, the connection point is determined by which voltage or current is to be controlled. Thus, if the line voltage is to be regulated between certain maximum and minimum voltages, the feedback loop may be connected before the resonant inductors $L_R$ such as at the point M in FIG. 7. Typically, the line voltage would be converted to a DC voltage by a full wave rectifier or the like and appropriately filtered before being applied to the high voltage DC terminals of FIGS. 6 through 8.

Figure 9:
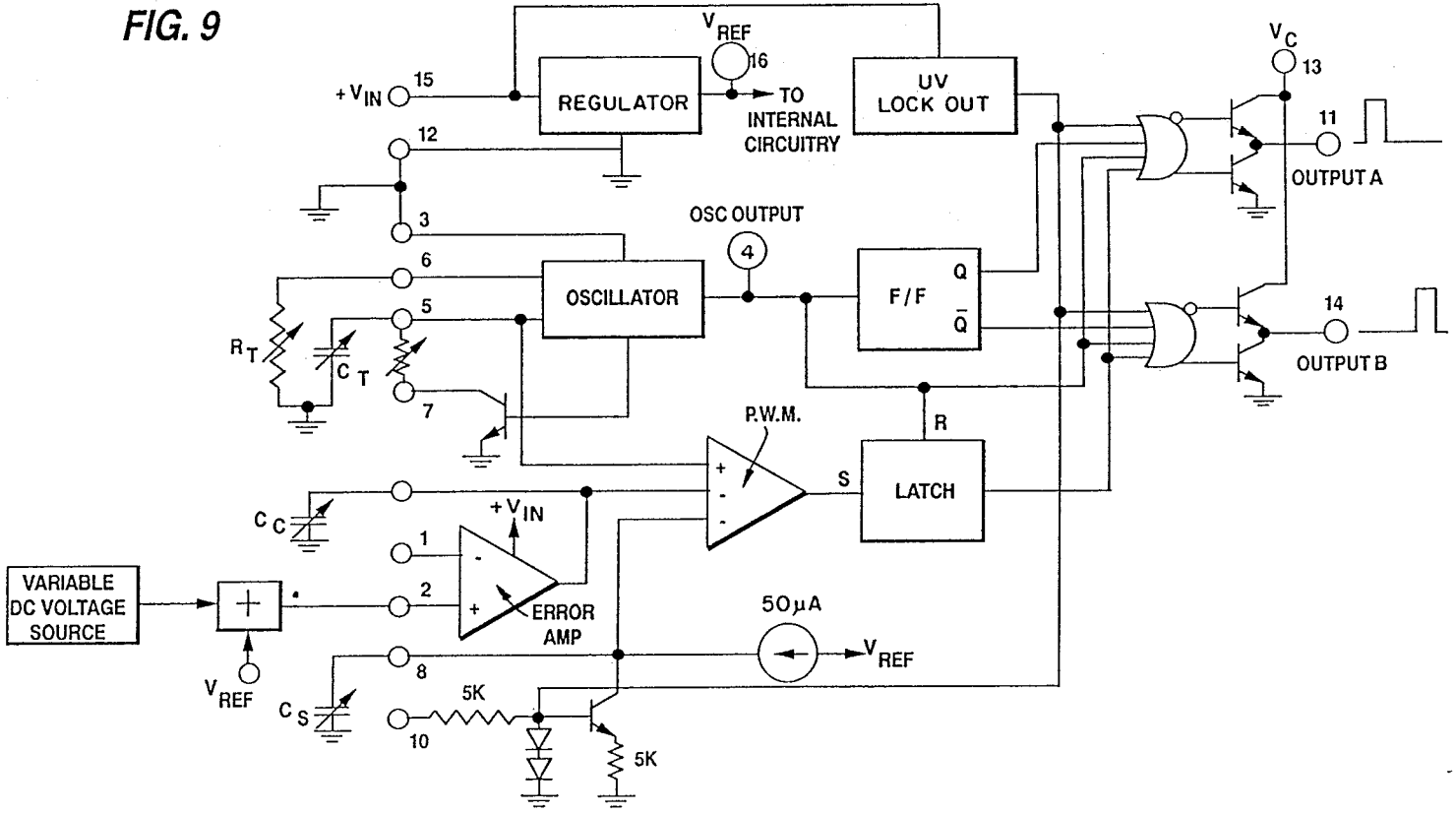
FIG. 9 is a schematic diagram of an illustrative control circuit for use with the circuitry of FIGS. 6–8.

Referring to FIG. 9, the feedback loop may be applied to pin 1 - that is, the inverted input of the error amplifier. Applied to pin 2 would be a reference voltage such as the internally generated $V_{REF}$. The output of the error amplifier is employed to pulse width modulate the control signal pulses occurring at outputs A and B of the control circuit as illustrated in FIGS. 6 through 9.

Respectively connected to pins 5 and 6 of the oscillator are typically a capacitor $C_T$ and a resistor $R_T$, both of which may be variable and which are connected to ground. By varying the latter capacitor and/or resistor the pulse repetition frequency of the pulses occurring at outputs A and B can be varied to thus provide another means for regulating line voltage or some other parameter of the converter circuitry of FIGS. 6 through 8.

Preferably the capacitor $C_T$ and resistor $R_T$ are set so that the pulse repetition frequency of the control pulses at outputs A and B is equal to the series resonant frequency of $C_R$ and $L_R$ to optimize efficiency of operation although these frequencies may differ. The frequency of the control pulses should be above 20 KHz to avoid noise, hum and flickering.

A resistor is typically connected between pins 5 and 7 to establish a dead time between the control pulses occurring at outputs A and B. Dead time helps to avoid cross conduction between the power switches. Dimming of the lamp(s) is preferably effected by adding a variable DC voltage via an adder to the reference voltage applied to the non-inverting input of the error amplifier, the variable DC voltage source typically including a rheostat. The added voltage from the variable DC voltage source (which can be remotely located) varies the duty cycle of the control pulses occurring at outouts A and B to thus effect dimming or the control of the light intensity. By varying the pulse width, the pulse repetition frequency remains unchanged and thus matched to the resonant frequency of the series resonant circuit. Although variation of the duty cycle is the preferred method of dimming, this may also be effected by other means such as variation of the pulse repetition frequency.

A capacitor $C_5$ may be connected to pin 9 to stabilize operation of the pulse width modulator (P.W.M.). Pins 3 and 12 are normally connected to ground while pin 15 which is connected to an internally generated reference voltage $+V_{IN}$ can provide a fixed reference voltage. Soft or slow starting of the lamp may be effected by a capacitor $C_5$ connected between pin 8 and ground. Shut down of the system whenever the line voltage exceeds a predetermined maximum, for example, may be effected by connection of appropriate over-voltage detection circuitry (not shown) connected to pin 10.

Further description of the UC 2525 circuit is not given here since the operation of the remainder of this circuit is known.

Based on the present invention, an experimental ballast (based on FIG. 7) was found to be about 92% efficient in converting electrical power. The experimental ballast was designed to run four lamps. This ballast was able to dim all four lamps fully and uniformly. Total cost of parts for this experimental ballast was under U.S. $20.00.

It is known that, according to the reference "Unitrode Switching Regulated Power Supply Design Seminar Manual", Unitrode Corporation, Lexington, Mass, 1985, p. 7–6 through 7–30 and, in particular, p. 7–20, the power conversion efficiency of a series resonant converter can be as high as 90%. However, in the present invention, the ballast based on FIG. 7 provided a power conversion efficiency of about 92%. This higher efficiency is probably due to the fact that normally power is being transferred to the load through the secondary of the power transformer TR (FIG. 6), but, even superior quality high frequency power transformers will have some core losses. In the present invention, this loss was avoided by replacing the transformer TR (FIG. 6) directly with fluorescent lamps T1, T2, etc., (FIG. 7). Thus, the efficiency increased.

Figure 10:
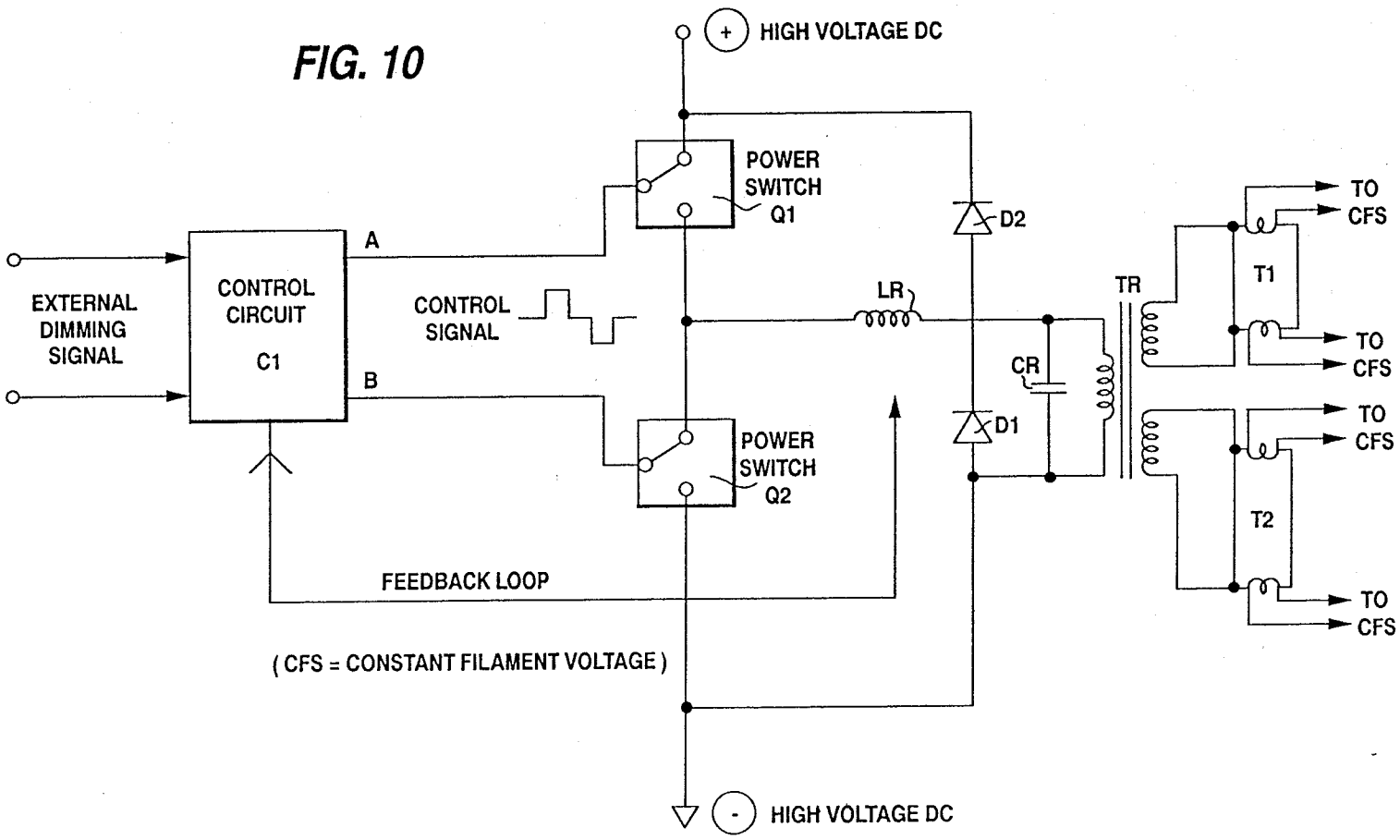
FIG. 10 is a schematic diagram of a further illustrative embodiment of the invention utilizing a parallel resonant circuit.

In addition to a series resonant converter, a parallel resonant converter concept may also be used to design a fluorescent lamp ballast. This is shown in FIG. 10. The basic difference between a series and a parallel resonant converter mostly lies in the fact that, in the case of a parallel resonant converter the load TR (FIG. 6) is usually placed in parallel with the capacitor CR (FIG. 10).

Figure 11:
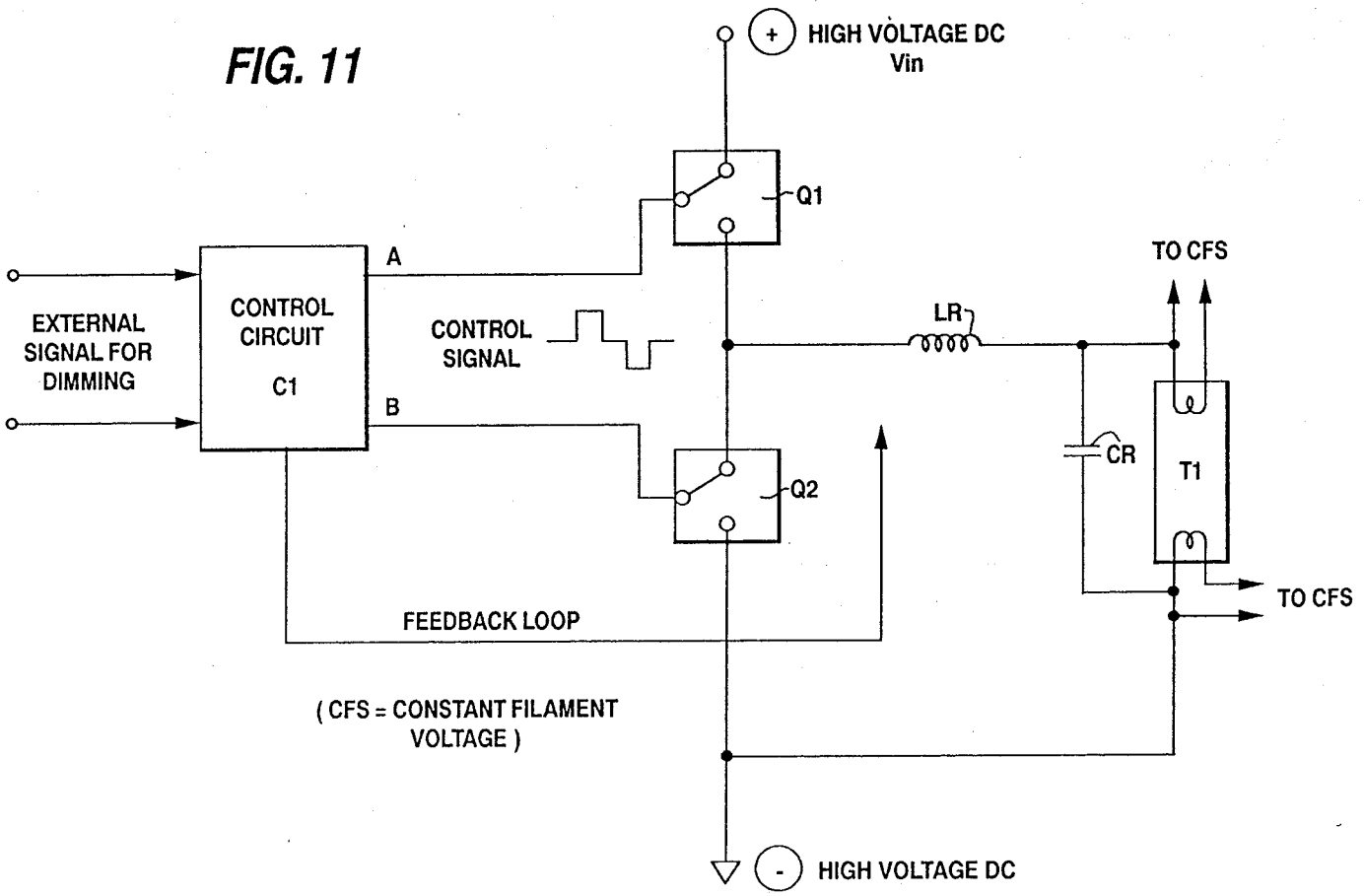
FIG. 11 is a schematic diagram of a further illustrative embodiment of the invention utilizing a further parallel resonant.

The basic block diagrams of a ballast based on resonant converters have been shown in FIG. 6 and FIG. 10. FIG. 6 shows a ballast circuit based on a series resonant converter technique and FIG. 10 shows a ballast circuit based on a parallel resonant converter technique. In both cases the fluorescent lamps T1 and T2 are part of the resonant circuit, as is the case in the other embodiments of the invention, since at least the lamp(s) affects the resonant circuit impedance and frequency of the convertor. One of the simplest, efficient and economical ballast configurations based on the parallel resonant converter technique is shown in FIG. 11.

In this case LR and CR form a resonant circuit together with the lamp T1 which acts as a load across CR. This is equivalent to the diagram of FIG. 12. The impedance Z of the circuit parameters of FIG. 12 can be described as follows: For the load, the impedance is RL, for the resonant capacitor, the impedance is 1/jw(CR), and for the resonant inductor, the impedance is jw(LR). Here, j is the complex number and $w=2\pi(fr)$ where fr is the excitation frequency. At resonance, w(CR)=w(LR).

Figure 12:
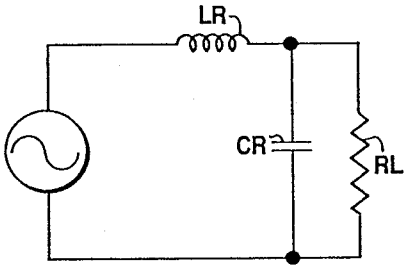
FIG. 12 is a equivalent circuit diagram of the FIG. 11 circuit.

In the case of FIG. 12, under the resonance condition, the voltage across CR or RL depends on the value of RL. In FIG. 11, RL is replaced by the lamp T1. Initially, before the lamp T1 fires, T1 offers a very high impedance and as a result the voltage across CR or T1 continues to increase. However, once the voltage across T1 reaches the lamp firing potential, the lamp T1 fires and offers much lower impedance. At this time, due to the lamp characteristic, the voltage across T1 clamps down to the normal lamp operating potential and stays there. This is a very convenient and reliable mechanism for starting and operating a fluorescent lamp.

Lamp operating potential depends on the lamp construction, its length, etc. For example, Table 1 shows some of the characteristics of commercially available Preheat -Rapid Start types of lamps.

TABLE 1

| Preheat - Rapid Start | Approx. Operating Amps. | Approx. Operating Volts | Min. Starting Volts |
|---|---|---|---|
| 32W F-8 48" | 0.265 | 135 | 300 |
| 40W T-12 3" U-Bent | 0.420 | 103 | 256 |
| 40W T-12 48" | 0.430 | 102 | 256 |
| 40W T-10 48" | 0.420 | 108 | 256 |
| 40W T-12 6" U-Bent | 0.430 | 102 | 256 |

Figure 13:
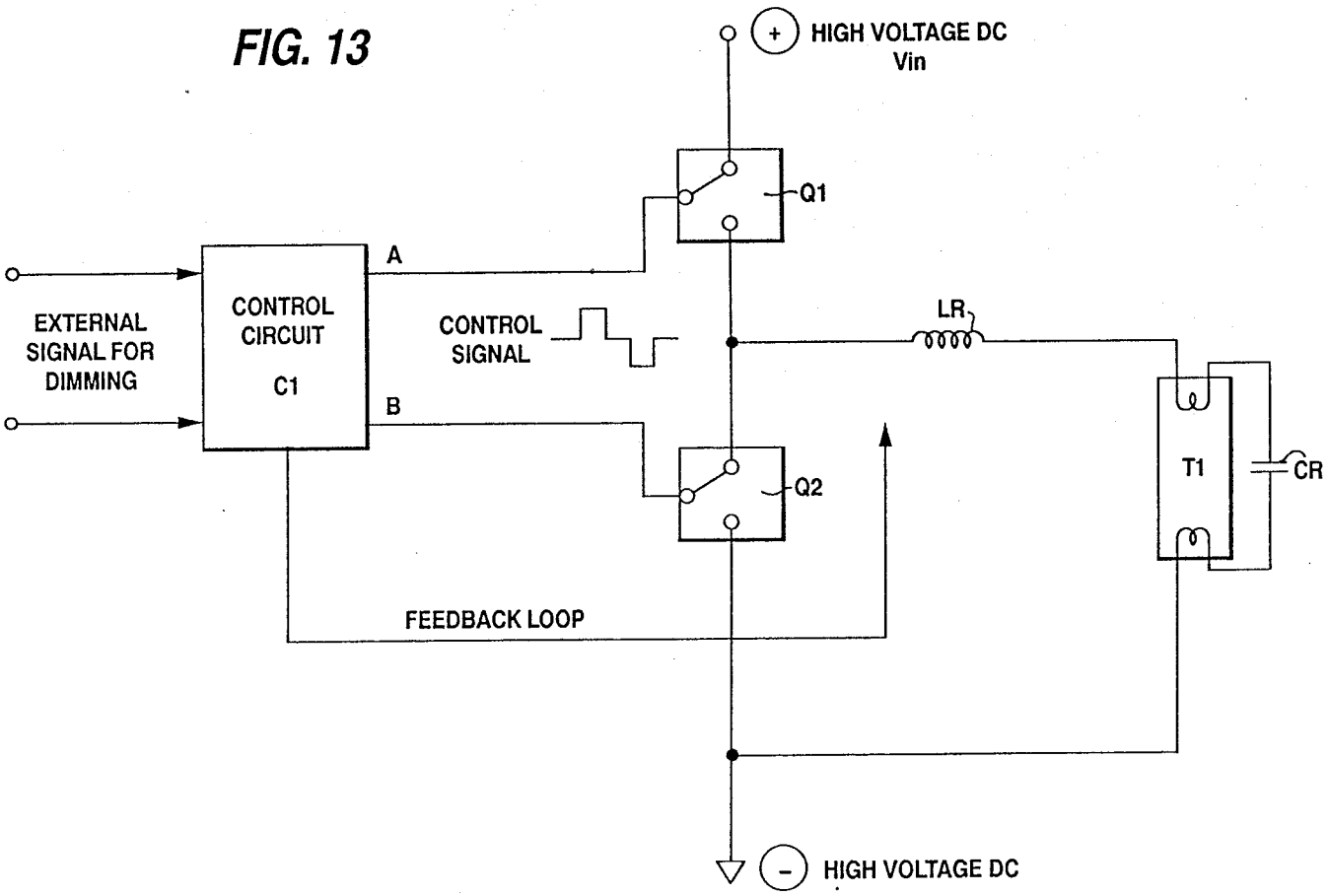
FIG. 13 is a schematic diagram of a further illustrative embodiment of the invention wherein the filaments of the lamp(s) are included in the resonant circuit of the converter.

A further improvement of the concept as implemented by the circuit of FIG. 11 is shown in FIG. 13. In FIG. 13, the filaments F1 and F2 are also part of the resonant circuit. This is true, because once the lamp T1 is removed, the resonant circuit becomes incomplete. Another advantage of the embodiment of FIG. 13 is that the capacitor CR automatically provides the constant filament power to the lamps. Thereby, the need for a separate power source for providing constant filament supply can be eliminated. This can be explained as follows.

Depending on the type of fluorescent lamp one can determine the normal operating voltage Vn of the lamp. It is also known that cold filament usually offers about 1–2 ohms resistance. However, when the tube is operating, hot filament resistance increases to about 14–16 ohms and draws approximately 0.25–0.27 Ampere currents. By knowing the lamps operating voltage Vn and lamp filament current, (If), one can find the impedance value of CR from the ratio (Vn)/(If) (ohms). Once the impedance ZCR of CR is known, by choosing a suitable resonance frequency fr, one can determine the value of CR and LR by the following formulae:

$$CR = \frac{1}{(2\pi fr)(ZCR)}$$

$$LR = \frac{(ZCR)}{(2\pi fr)}$$

Figure 14:
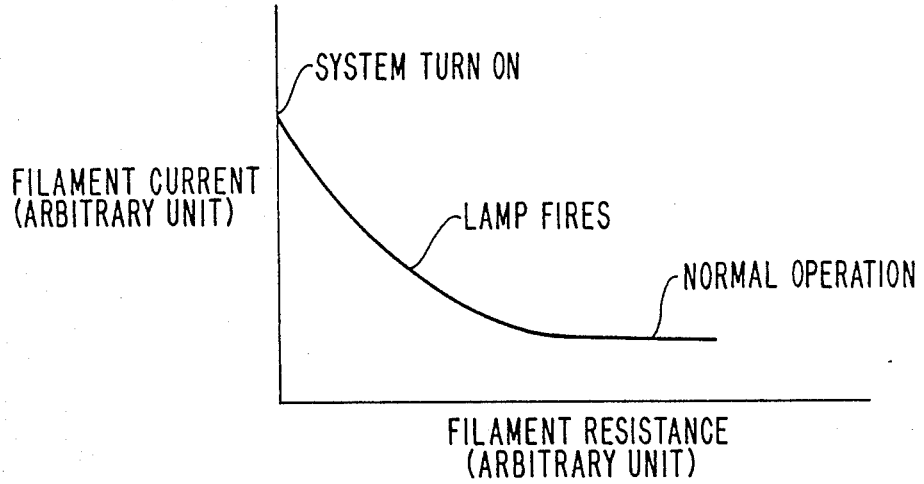
FIG. 14 is a graph illustrating filament resistance versus filament current in a conventional fluorescent lamp.

Another advantages of the FIG. 13 embodiment is that this circuit helps to increase the life of the fluorescent lamps. This is due to the following. In the case of an ordinary ballast when the ballast is first turned on, the ballast instantly supplies power to the cold filament. Since, the cold filament resistance is very low, the filament draws a large amount of current, causing a thermal and electrical shock to the filament. This is probably the most important reason why the fluorescent lamp usually goes bad during the turn on period. Fliament resistance vs. the filament current is shown in FIG. 14.

Figure 15:
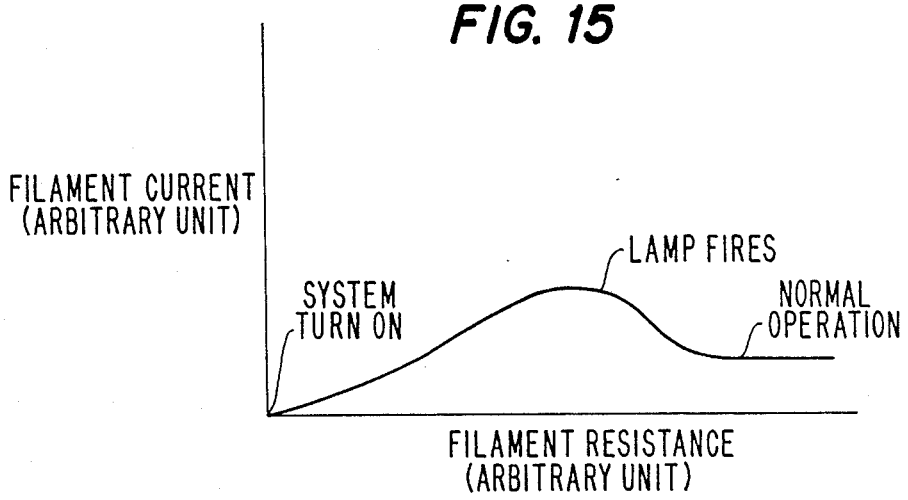
FIG. 15 is a graph illustrating filament resistance versus filament current utilizing the soft starting capability of the present invention.

In the case of FIG. 13, due to the resonance phenomenon, voltage across CR and also the current through CR starts to increase from zero. This allows a soft starting of the overall system and thereby increases lamp life. This is shown in the graph of FIG. 15.

Figure 16:
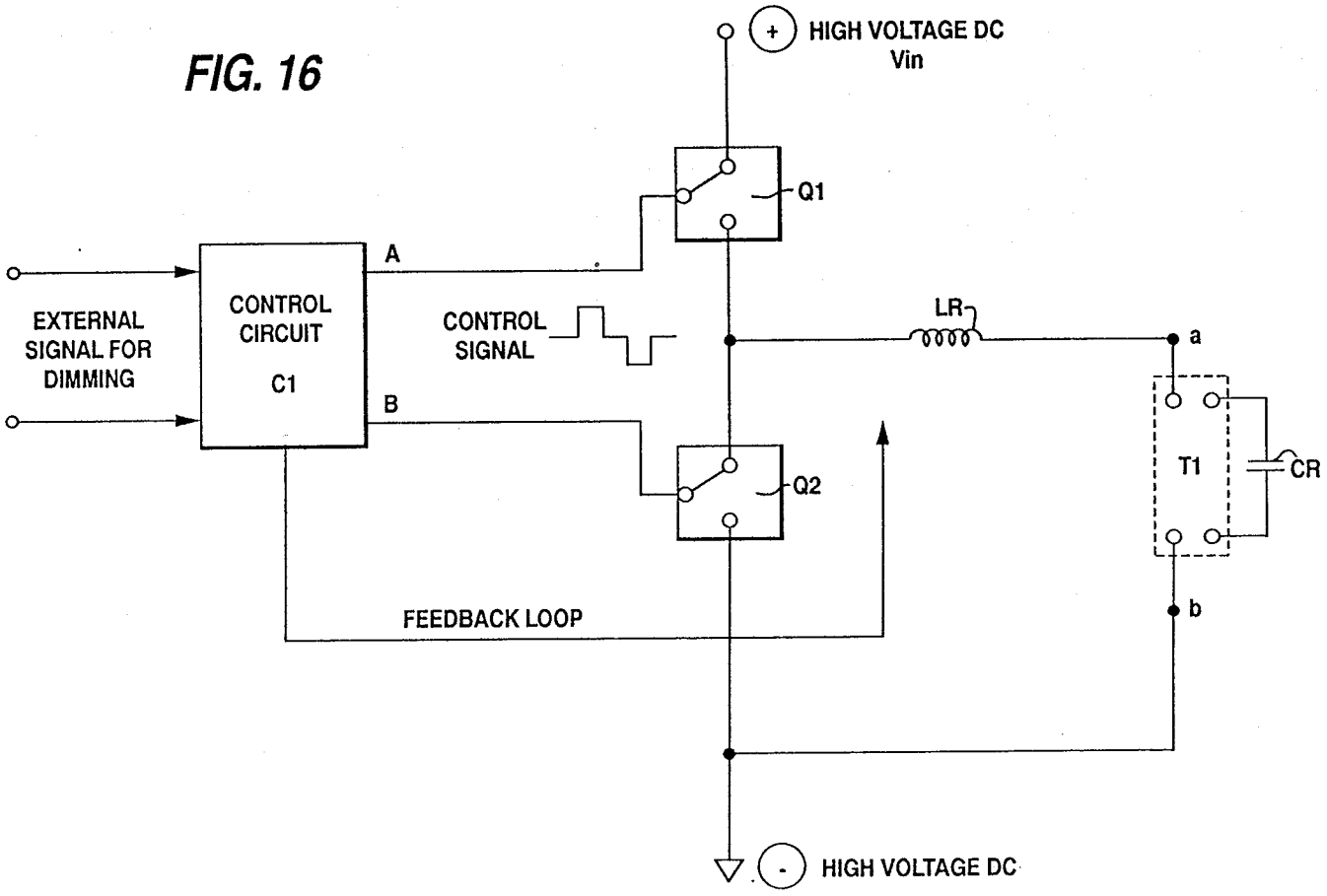
FIG. 16 is a schematic diagram of the FIG. 13 circuit with the lamp removed.

Another advantage of the ballast based on the resonant converter technique is that the circuit can be designed to provide very safe open line voltage, which is the voltage across the lamp when the lamp is removed from the circuit. For example, in the case of FIG. 13, when the lamp T1 is removed, the resonance circuit becomes incomplete. This is shown in FIG. 16. Voltage appears across the points a and b is approximately the same as Vin. Depending on the impedance of the resonance circuit and lamp current requirement, Vin can be much smaller than the lamp firing potential. This is true again due to the resonance property of the circuit, because, once the lamp T1 is in the circuit, the potential across T1 will continue to grow until the lamp fires. For example, a ballast for a 4 feet 40 watt lamp has been constructed based on the circuitry of FIG. 13. Circuit values are: Vin=245 Volts, LR=1.8 mili Henry, CR=0.015 micro Farad, resonance frequency=30 kilo Hertz. For this ballast the measurement shows the following: Open line voltage=240 Volts, starting voltage=260 volts, lamp operating voltage=103 Volts and filament Voltage=3.2 Volts. Lower open line voltage is very desirable for electrical safety reasons.

Another advantage of the circuitry of FIG. 13 can be realized as follows. A fluorescent lamp operating under dimming conditions demands somewhat more filament power for longer lamp life and for stable operation. Reduced filament power can significantly reduce lamp life while the lamp is running under a dimming situation. With the FIG. 13 circuit, under a dimming situation, the lamp offers more impedance and the operating potential which maintains the discharge in the lamp increases slightly. Thereby, the resonant capacitor CR sees a higher voltage and this causes the filament voltage to increase also slightly. This ensures longer lamp life and stable operation of the lamp.

Another advantage of the circuitry of FIG. 13 can be described as follows: It is known that the lamp current crest factor has direct influence on the lamp life. A lamp which is excited by sinusoidal current has the maximum lamp life. In the FIG. 13 circuit, the sine wave resonant converter technique guarantees sinusoidal current in both the lamp and in the filament.

Figure 17:
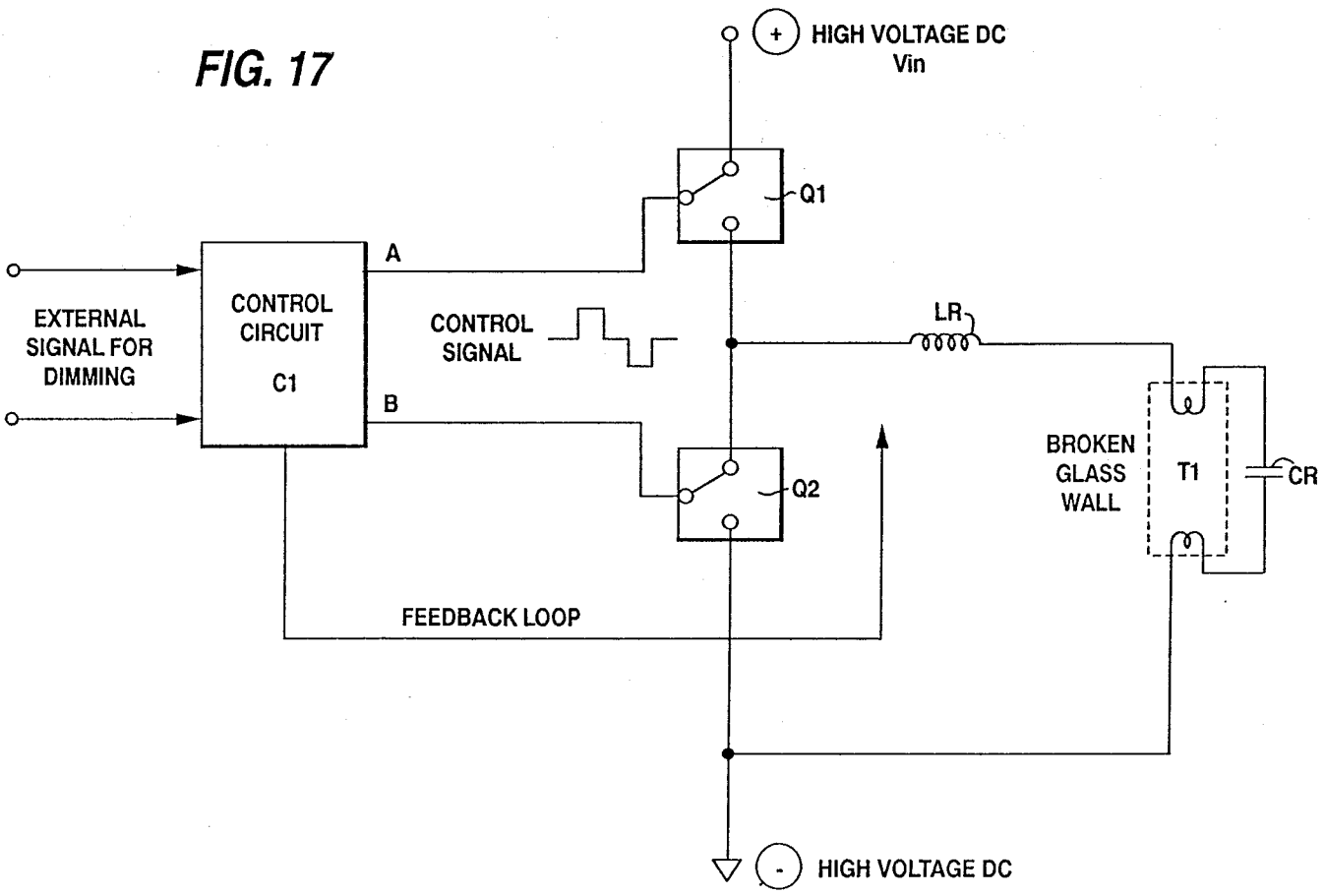

Another important consideration relating to the FIG. 13 circuit and the other ones of the circuits of this invention is the following: (1). During the start up period, say it takes 300 volts across a lamp for starting. From the time of application of 300 volts across the lamp, it takes some finite amount of time for the lamp to start. This finite amount of time delay, TD, is due to primarily gas ionization time, ambient temperature, filament temperature, etc. In the case of FIG. 13, depending on the magnitude of the time delay (TD), owing to the electrical resonance property and much faster response time characteristic of the circuit, the voltage across the lamp may continue to grow to a dangerous level before the lamp fires. (2). A similar situation may arise while dealing with a lamp whose glass wall is broken but the filaments are good. This is shown in FIG. 17. In this case, the resonance circuit is complete. But, due to the broken glass wall, the lamp cannot fire. As a result, due to the absence of any finite amount load across the resonant capacitor, CR, the voltage will continue to grow until the filament(s) burns.

Figure 18:
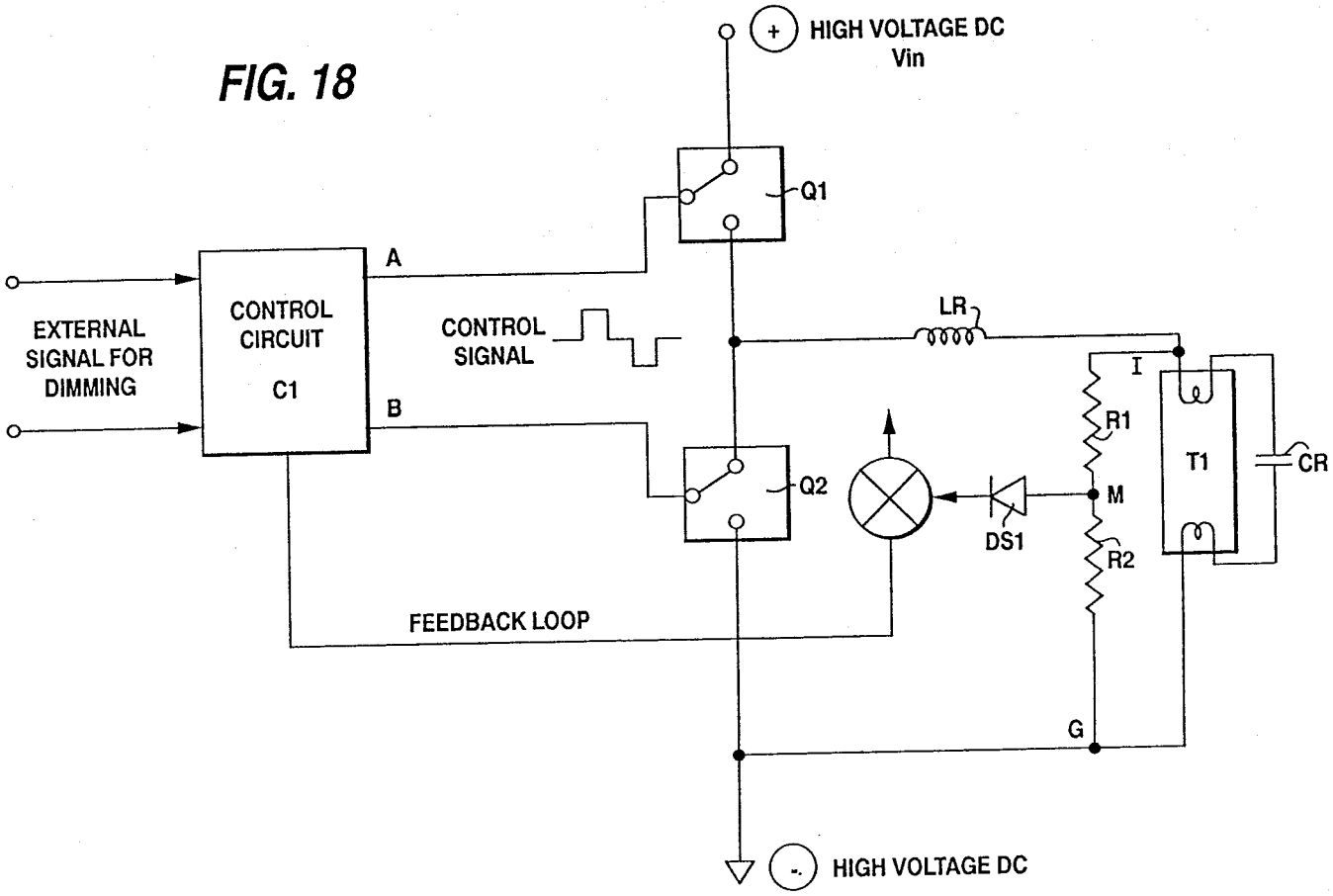

In either case, for safety and reliability reasons, it is desirable to restrict the voltage growth across the lamp or across the resonant capacitor CR. One straightforward embodiment for effecting this is shown in FIG. 18. In FIG. 18, R1 and R2 is a high impedance resistance divider connected between points I and G, for the purpose of sensing voltage across CR and T1. The value of R1 is much higher than R2 and thereby, the voltage developed across R2 is much smaller than the voltage across R1. Through a semiconductor diode (DSI), voltage sense signal is fed back to main control circuit (C1) for the purpose of controlling the amount of voltage growth across CR or T1. The control circuit (C1), for example, can regulate the voltage across the CR by varying the duty cycle of the control signal which turns on or off the power switches Q1 and Q2, as discussed above with respect to FIG. 9.

In summary, the present invention consists of a unique solid state ballast for fluorescent lamps, having the following advantages:

(1) Very economical and reliable.

(2) The ballast can be made fully dimmable where the dimming signal can be applied remotely.

(3) The ballast is based on resonant sine wave converter technology. Sinusoidal current excitation of the lamps and zero current switching of power semiconductor switches make the overall system highly efficient, more reliable and helps reduce EMI. For human safety reasons and for normal operation of other electronic equipments it is always desirable to have lower or no electro-magnetic radiation from any nearby devices.

(4) The ballast can be made to operate any number of lamps either in parallel or any other series parallel combinations. Parallel lamp assembly makes the operation of the lamp independent of each other and also reduces maintenance cost.

(51) With proper feedback, the ballast can be made to provide constant light output irrespective of the line voltage variation.

(6) Separate but constant filament voltage can be applied under all conditions to the individual filaments of the lamps in order to achieve higher efficiency and longer lamp life.

(7) The ballast can be made to operate at a high switching frequency and thereby eliminate AC buzz and flickering.

The resonance converter technique, for example, the circuits of FIG. 11 and the other FIGS., can easily be incorporated to make very reliable, efficient and economical ballasts for any type of lamps which are based on a gas discharge principle. For example, neon signs, high pressure sodium vapor lamps, etc.

What is claimed is:

1. In combination, at least one fluorescent lamp;

a DC voltage supply where said DC voltage corresponds to the difference between a first voltage level and a second voltage level;

converter means including (a) a resonant circuit for converting said DC voltage to a sinusoidal current (b) a pair of controllable switches connected between said first and second voltage levels, (c) control means for alternately generating a pair of control pulse trains for alternately switching said switches on and off where the pulse repetition frequencies of the pulse control trains are the same to thus switch said first and second voltage levels to said fluorescent lamp at the pulse repetition frequency of said pulse control trains under the control of the resonant circuit so that said lamp is excited by said sinusoidal current, and (d) means for varying the duty cycles of said pulse control trains to thus effect dimming of the lamp light intensity; and where the frequency of the sinusoidal current remains the same as that of the resonant circuit both for the initial excitation of the lamp and for the continued operation of the lamp subsequent to the initial excitation.

2. The combination as in claim 1 where said load means includes a transformer for transformer coupling the resonant circuit to the lamp.

3. The combination as in claim 1 where said lamp is in series circuit with said resonant circuit.

4. A combination as in claim 1 including a plurality of fluorescent lamps, all of which are connected in parallel.

5. The combination of claim 1 where said convertor means includes means for dimming the light intensity of the lamp.

6. The combination of claim 5 including means for remotely controlling the dimming means.

7. The combination of claim 1 including means for supplying constant voltage to the fluorescent tube filaments.

8. The combination of claim 1 where said convertor means includes means for regulating line voltage.

9. The combination of claim 1 where said convertor means includes means for substantially eliminating AC buzz and flickering of the fluorescent lamp.

10. The combination as in claim 1, where said resonant circuit is a series resonant circuit and said load means are connected in series with the series resonant circuit.

11. The combination as in claim 10 where said series resonant circuit includes an inductor and a capacitor.

12. The combination as in claim 11 where said inductor and said capacitor are disposed on opposite sides of the load means.

13. The combination as in claim 11 where said inductor and said capacitor are disposed on opposite sides of the load means.

14. The combination as in claim 10 where said series resonant circuit and said lamp are connected in series resonant circuit.

15. The combination as in claim 10 including a transformer for transformer coupling said series resonant circuit to said lamp.

16. The combination of claim 10, where said controllable switches are connected in series between said first and second voltage levels and the circuit including said series resonant circuit and said load means is connected to a point intermediate the first and second controllable switches.

17. The combination as in claim 10 including means for rendering the pulse repetition frequency of the control pulse trains substantially equal to the resonant frequency of the series resonant circuit.

18. The combination as in claim 10 where said control means includes means establishing said pulse repetition frequency at a frequency greater than 20 KHz to avoid lamp hum.

19. The combination as in claim 1 where said duty cycle varying means is remotely located with respect to said control means.

20. The combination as in claim 1 where said resonant circuit is a series resonant circuit.

21. The combination as in claim 1 where said resonant circuit is a parallel resonant circuit.

22. The combination as in claim 10 where said resonant circuit includes at least one capacitor and at least one inductor and where said load means is connected in parallel with said capacitor.

23. The combination as in claim 22 where said lamp is connected in parallel with said capacitor.

24. The combination as in claim 23 where said lamp includes a pair of filaments, said capacitor being connected between said filaments.

25. The combination as in claim 24 where said resonant circuit includes said inductor, said filaments and said capacitor.

26. The combination as in claim 25 where said inductor, said filaments and said capacitor are connected in series.

27. The combination as in claim 26 where said pulse repetition frequencies of the pulse control trains are the substantially same as the resonant frequency of said inductor, said filaments and said capacitor.

28. The combination as in claim 10 including means for preventing the voltage across said lamp from exceeding a predetermined voltage.

29. The combination as in claim 28 including means for preventing the voltage across said lamp from exceeding a predetermined voltage.

* * * * *